United States Patent [19]

Miller et al.

[11] Patent Number: 4,785,964

[45] Date of Patent: Nov. 22, 1988

[54] STEP-ON WASTEBASKET

[75] Inventors: David C. Miller, Ridgefield; Thomas J. Pendleton, Danbury, both of Conn.

[73] Assignee: Mobil Oil Corporation, New York, N.Y.

[21] Appl. No.: 109,879

[22] Filed: Oct. 19, 1987

[51] Int. Cl.[4] ..... B65D 43/00

[52] U.S. Cl. ..... 220/263; 220/1 T

[58] Field of Search ..... 220/262, 263, 264, 1 T

[56] References Cited

U.S. PATENT DOCUMENTS

| | | | |
|---|---|---|---|
| 1,236,429 | 8/1917 | Hansen | 220/263 |
| 1,584,552 | 5/1926 | Kent | 220/263 |
| 1,966,323 | 7/1934 | Von Elm | 220/263 |
| 2,046,777 | 7/1936 | Geibel | 220/263 X |
| 2,216,279 | 10/1940 | Packer | 220/263 |
| 2,563,456 | 8/1951 | Brownell | 220/263 |
| 3,088,425 | 5/1963 | La Rue | 220/263 X |
| 4,150,764 | 4/1979 | Anderson | 220/1 T X |

*Primary Examiner*—Steven M. Pollard

*Attorney, Agent, or Firm*—Alexander J. McKillop; Michael G. Gilman; Charles J. Speciale

[57] ABSTRACT

A wastebasket includes a container having a top opening, and a lid mounted on the container and adapted to pivot about a pivot axis to cover and uncover the top opening. A mechanism for actuating pivotal movement of the lid with respect to the container is provided. The mechanism includes a generally horizontal operating lever having a foot pedal, a depending flange joined to the lid, and a rod linkage interconnecting the operating lever and the flange. The lid flange has an elongated slot formed through its thickness. The slot includes a channel and two enlargements situated at opposite ends of the channel. The rod linkage slides through the channel into one of the two enlargements, and engages the lid flange at either enlargement to pivot the lid between positions covering and uncovering the container. The lid flange includes a ridge protruding inwardly of the slot near one of the enlargements to help guide the rod linkage into engagement with the lid flange at the top of the enlargement so that the rod linkage does not inadvertently slip from the enlargement and into the channel of the slot.

13 Claims, 7 Drawing Sheets

STEP-ON WASTEBASKET

BACKGROUND OF THE INVENTION

1. Field of the Invention

This invention relates to wastebaskets or trash receptacles, and more particularly relates to a wastebasket with a pivoting lid which opens and closes by operation of a foot pedal.

2. Description of the Prior Art

U.S. Pat. No. 2,475,125 to Brownell discloses a foot pedal operated receptacle. One of the primary features of the receptacle disclosed in the Brownell patent is that the lid of the receptacle will open and close in response to actuation of the foot pedal.

This feature of the Brownell receptacle is provided by a straight slot 40 formed in a hinge element 39 joined to the lid. The slot is sloped from the vertical, and has first and second end enlargements 41, 42, one being higher than the other, depending on whether the lid is open or closed. A link member 16 interconnects the hinge element's slot with the foot pedal 15.

When the lid is closed and the foot pedal is stepped on, the link member engages the lower first enlargement and pivots the lid to an open position. When the foot pedal is released, the link member slides down to the second enlargement, which is now the lower of the two. When the foot pedal is stepped on again, the link member now engages the lower second enlargement and pivots the lid in an opposite direction back to the closed position.

The receptacle disclosed in the Brownell patent has a number of disadvantages inherent in its design. One problem relates to the mechanism for pivoting the lid. The slot formed in the lid hinge member is straight and is not particularly shaped to guide the link member between enlargements. The receptacle is configured so that the link member 16 alternately tilts towards whichever enlargement is lower, that is, toward and away from the receptacle's casing 10, to ensure that it properly engages the enlargement to pivot the lid. The link member must be pivotally connected to the foot pedal at a point which is directly below the lid's pivot axis, or at most between the two enlargements, so that it will tilt in the proper direction, as shown in FIG. 1 of the Brownell patent. Accordingly, the foot pedal must extend beyond the periphery of the casing 10 so that it may be joined to the link member at a point below the lid's pivot axis.

If the link member's connection to the foot pedal were situated closer to the receptacle's casing, the link member would not be properly directed towards the more inner enlargement 41. As a result, when the foot pedal is depressed, the link member may not properly engage the enlargement, and may slip out of the enlargement into the slot.

Thus, with the design taught by the Brownell patent, the link member 16 and the portion of the pedal to which it is connected must protrude relatively far beyond the periphery of the receptacle's casing. Not only is it unsightly to see the linkage between the pedal and lid protruding beyond the confines of the casing, but also it makes the receptacle undesirable for use in areas of limited space. For example, the receptacle cannot be placed close to a wall, as space must be provided for the link member and rear portion of the foot pedal.

Also, because the linkage is exposed, it remains unprotected. The linkage, and in particular link member

16, may become bent or damaged and fail to operate properly if the Brownell receptacle fell on its side.

Furthermore, the foot pedal 15 protrudes outwardly from the front side of casing 10 diametrically opposite from the exposed link member. This exacerbates the problem of using the wastebasket in confined areas, as the protruding pedal and link mechanism add to the overall dimensions of the receptacle.

Yet another disadvantage of the Brownell receptacle and of many prior art pedal operated receptacles is that the pedal is of too limited size. The pedal on many such receptacles are narrow in width, and are about the size of the user's foot. The pedal covers only a small area of the receptacle's periphery, which makes it more difficult for the user to properly position his foot on the foot pedal, and requires the user to stand usually in a particular position close to the receptacle in order to operate the pedal.

OBJECTS AND SUMMARY OF THE INVENTION

It is an object of the present invention to provide a wastebasket or trash receptacle having a lid may be opened and closed by actuation of a foot pedal.

It is another object of the present invention to provide a pedal operated wastebasket which is perfectly adaptable for use in confined areas.

It is a further object of the present invention to provide a wastebasket having a wide foot pedal which may be stepped on at substantially any point on the pedal to open and close the lid of the wastebasket.

It is yet another object of the present invention to provide a wastebasket having a foot pedal and interconnecting linkage to the lid which are substantially recessed so that they do not protrude from the general outline of the wastebasket.

It is still another object of the present invention to provide a wastebasket which is more aesthetically pleasing in appearance than conventional pedal operated wastebaskets.

It is yet another object of the present invention to provide a wastebasket which overcomes the inherent disadvantages of known wastebaskets, including that disclosed in U.S. Pat. No. 2,475,125 to Brownell.

In accordance with one form of the present invention, a wastebasket includes a container and a lid pivotally mounted on the container. The container includes a top opening. The lid is adapted to pivot on the container to cover and uncover the top opening.

The wastebasket also includes a mechanism to open and close the lid. The mechanism includes a generally horizontal operating lever (i.e., a foot pedal and its associated parts) mounted on the container, and a depending flange mounted on the lid, which flange has a slot formed through its thickness. The mechanism also includes a link member, such as an elongated metal rod, interconnecting the operating lever with the lid flange.

The slot formed in the lid flange includes an elongated channel, and first and second enlargements situated at opposite ends of the channel. The slot is generally sloped to the vertical so that one enlargement will always be higher than the other, the relative heights of the enlargements reversing when the lid is opened and closed.

The upper end of the link member slides in the slot between the first and second enlargements. When the foot pedal of the operating lever is stepped on and the lid is in the closed position covering the top opening of the container, the link member engages the lid flange at the first enlargement, which is lower than the second, and exerts a force on the flange to pivot the lid to the open position. When the lid is in the open position, the second enlargement is now the lower one. Releasing the foot pedal allows the upper end of the link member to slide by gravity to the lower second enlargement. Stepping on the foot pedal while the lid is in the open position causes the upper end of the link member to engage the lid flange at the second enlargement and exert a force on the flange to pivot the lid in the opposite direction to the closed position.

The foot pedal of the operating lever extends substantially across the entire front of the wastebasket. The foot pedal and operating lever are reinforced by ribs on their undersides so that if the foot pedal is stepped on at any point over its width, it will open or close the lid.

Also, the foot pedal is exposed but recessed inwardly of the wastebasket's general outline, and the link member is substantially disposed within a channel formed in the back of the wastebasket. Thus, neither the foot pedal nor the link member protrudes to any substantial degree from the wastebasket, providing the wastebasket with a slim line and aesthetically pleasing appearance, and providing protection for the link member.

A preferred form of the wastebasket, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
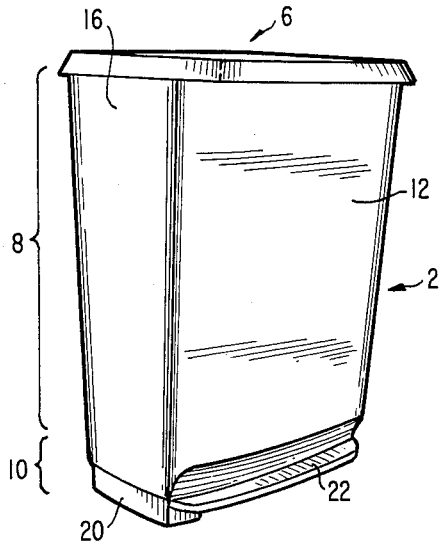
FIG. 1 is a front perspective view of a wastebasket formed in accordance with the present invention.
Figure 2:
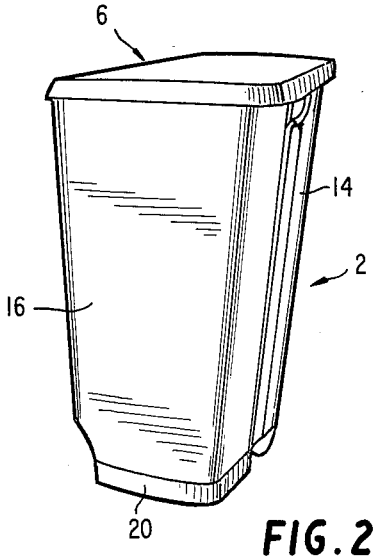
FIG. 2 is a side perspective view of the wastebasket shown in FIG. 1.
Figure 3:
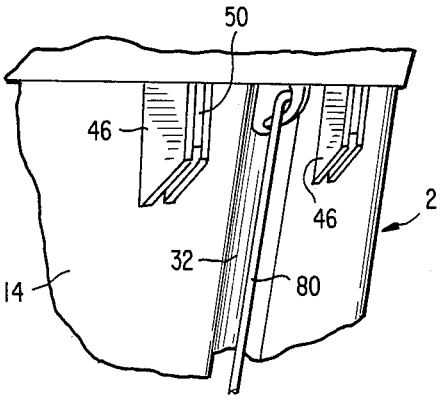
FIG. 3 is a rear perspective view of a portion of the wastebasket.
Figure 4:
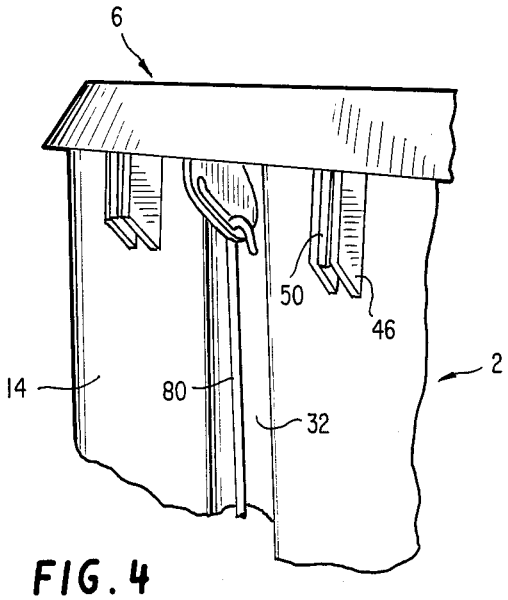
FIG. 4 is a rear perspective view of a portion of the wastebasket taken from a different angle than that of FIG. 3.
Figure 7:
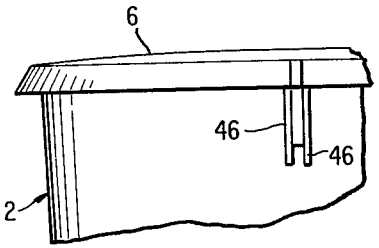
FIG. 7 is a rear elevational view of a portion of the wastebasket.

Referring initially to FIGS. 1 through 10 of the drawings, it will be seen that a wastebasket formed in accordance with the present invention basically includes a container 2 having an open end 4, and a lid 6 pivotally mounted on the container to cover and uncover the open end.

In its preferred form, the container 2 has an overall rectangular shape when viewed from above, and includes an upper section 8 and a lower section 10 on which the upper section 8 rests. The upper section 8 consists of a front wall 12, a rear wall 14, two opposite lateral walls 16, and a bottom wall 18, all of which are joined together at substantially rounded corners. The walls 12–16 of the upper section taper slightly inwardly from top to bottom at about a 3° angle from the vertical.

The lower section 10 includes parallel side walls 20 set inwardly from the walls of the upper section 8. As will be described, lower section 10 provides an interior area for mounting the foot pedal 22 and operating lever 24 for opening and closing the lid.

Figure 8:
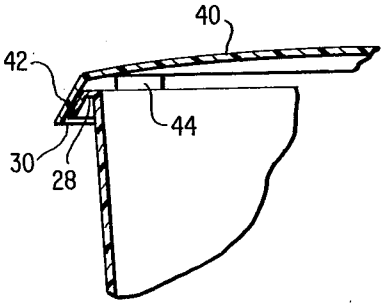
FIG. 8 is an enlarged view of that portion of the wastebasket shown in the circle A of FIG. 6.

The upper edges of the walls 12–16 of the container are joined together to form a rim 26. Preferably, as shown in FIG. 8, the rim 26 is downturned on the outside of the container, and includes a flat horizontal portion 28 and a downwardly sloping edge portion 30 extending from the horizontal portion. The downturned rim 26 strengthens the container at its open end 4.

Figure 10:
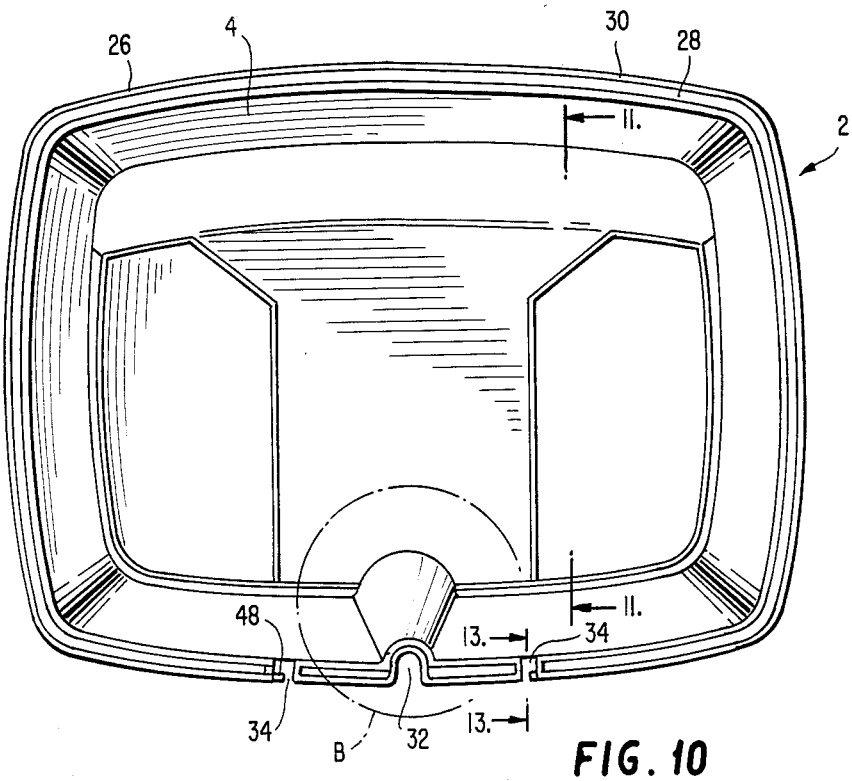
FIG. 10 is a top plan view of the wastebasket without the lid.
Figure 11:
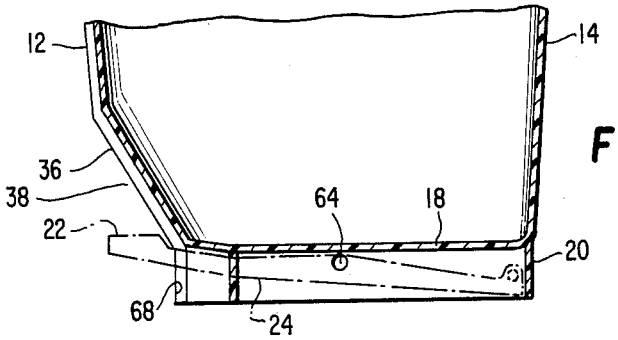
FIG. 11 is a sectional view of the lower portion of the wastebasket, taken along line 11—11 of FIG. 10.
Figure 12:
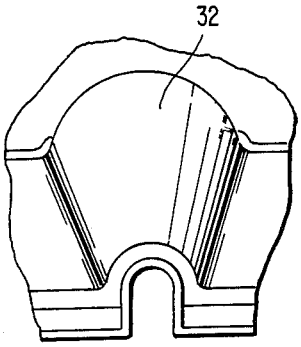
FIG. 12 is an enlarged view of that portion of the wastebasket shown in circle B of FIG. 10.
Figure 13:
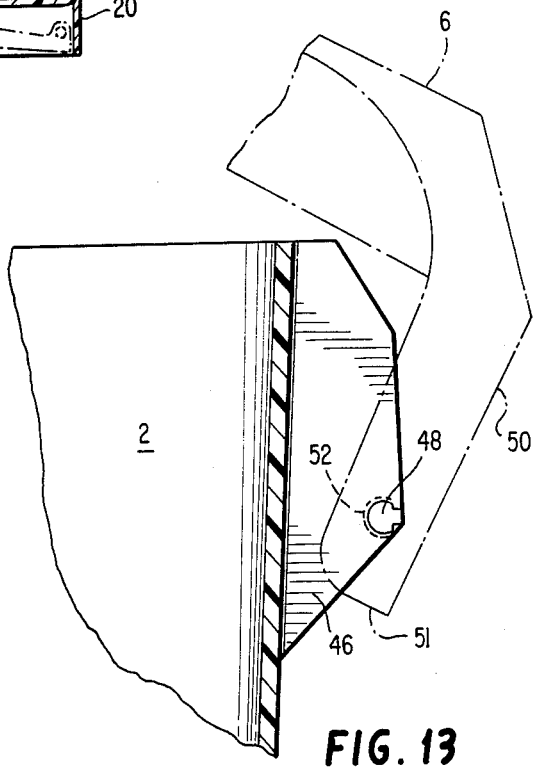
FIG. 13 is a sectional view of a portion of the wastebasket, taken along line 13—13 of FIG. 10, with the lid shown in dashed lines.
Figure 14:
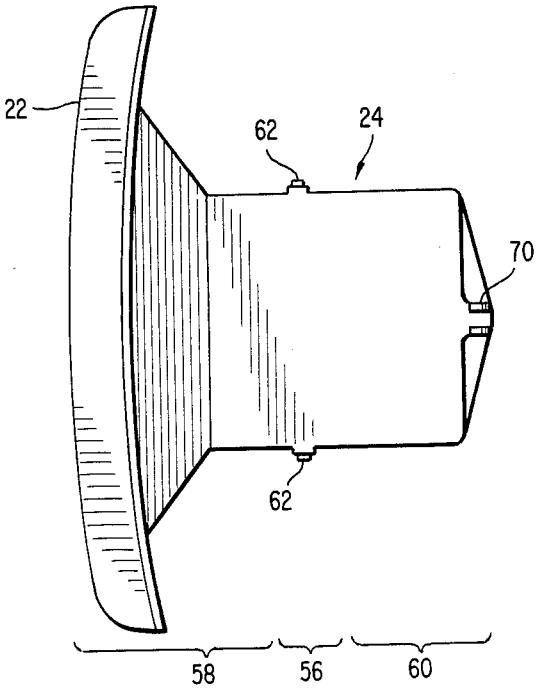
FIG. 14 is a top plan view of the foot pedal portion of the wastebasket.
Figure 15:
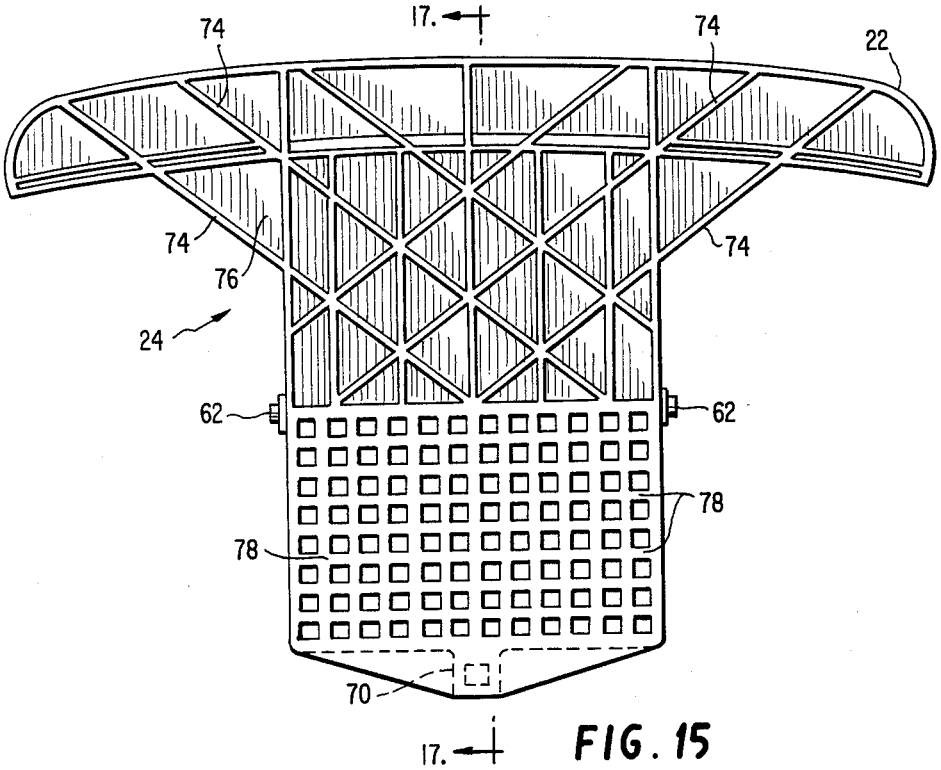
FIG. 15 is a bottom plan view of the foot pedal portion shown in FIG. 14.
Figure 16:
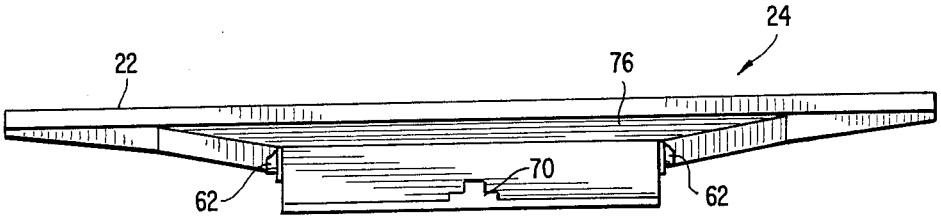
FIG. 16 is a rear elevational view of the foot pedal portion shown in FIG. 15.
Figure 17:
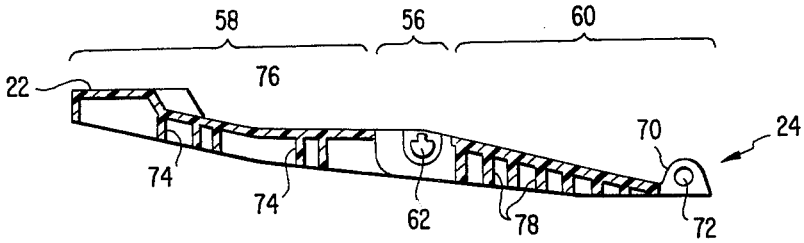
FIG. 17 is a sectional view of the foot pedal portion shown in FIG. 15, taken along lines 17—17 of FIG. 15.

As shown in FIG. 10, the container rim 26 extends continuously about the open end of the container except where it partially defines a channel 32, and in two other places where it terminates to define slots 34. The function of the channel 32 and slots 34 will be described in detail later.

Figure 6:
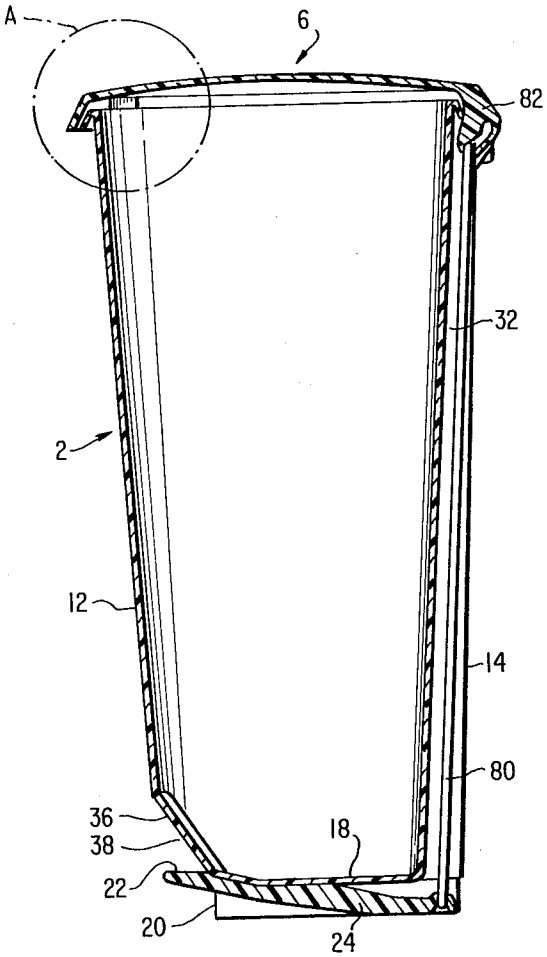
FIG. 6 is a sectional view of the wastebasket, taken along line 6—6 of FIG. 5.
Figure 5:
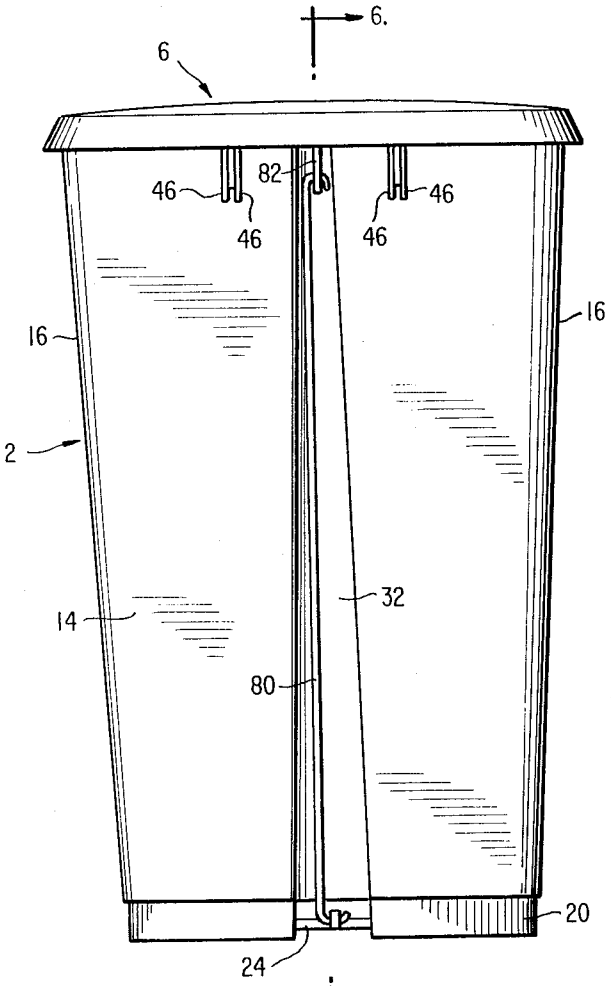
FIG. 5 is a rear elevational view of the wastebasket shown in FIG. 1.

The front wall 12 of the container includes an inwardly sloping lower wall 36 which, as shown more clearly in FIG. 6, defines a recess 38 across the entire front of the wastebasket for receiving the foot pedal 22. The slope and height of the lower wall 36 and the outward length of the foot pedal 22 are chosen so that the foot pedal does not substantially extend beyond the plane of the front wall 12, as illustrated by the dashed lines in FIG. 6. With this configuration, the foot pedal 22 of the wastebasket does not protrude beyond the general outline of the wastebasket, and yet is exposed for easy access.

The lid 6 of the wastebasket is substantially rectangular in shape to conform to the overall shape of the container 2. It includes a generally flat or slightly convex top wall 40, and a rim 42 which extends about the periphery of the top wall 40 and slopes downwardly and outwardly from the top wall. The lid rim 42 substantially parallels the edge portion 30 of the container rim and extends to or slightly below the edge of the container rim 26 so that it can mount closely on the container and hide the container rim from view when the lid is in the closed position covering the container's open end 4.

Figure 9:
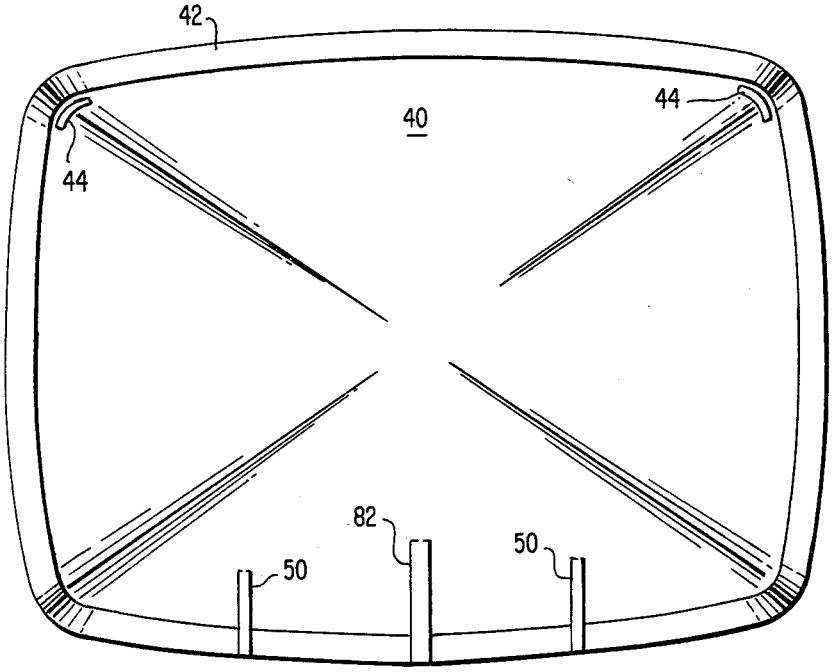
FIG. 9 is a bottom plan view of the lid of the wastebasket.

The lid 6 further includes two support members 44 which project downwardly from the underside of the lid's top wall 40, as shown in FIGS. 8 and 9. The support members 44 engage the horizontal portion 28 of the container rim at the two front corners of the container, and function to support the lid on the rim 26 of the container.

As mentioned earlier, the lid 6 is mounted on the container 2 and is pivotable between a closed position, covering the container's open end 4, and an open position, where it is in a substantially upright, vertical disposition uncovering the open end. The structure for mounting the lid on the container is shown in FIGS. 3–5, 7, 9 and 10 and will now be described.

Two pairs of parallel, spaced apart ribs 46 are provided on the container. The ribs 46 of each pair straddle a corresponding slot 34 formed in the container rim and extend outwardly from the rear wall 14 of the container and downwardly from the container rim 26. A pin 48 extends from one rib 46 of each pair partially across the gap between the ribs, providing enough space between the free end of the pin 48 and the adjacent rib to allow a hinge element of the lid to be inserted between them.

The lid includes a pair of spaced apart hinge elements 50 formed as planar, depending members joined to the top wall 40 and rim 42 of the lid. Each hinge element 50 is formed with an aperture 52 through its thickness, which aperture receives a corresponding mounting pin 48. The lid is mounted on the container by force-fitting the hinge elements 50 between the ribs 46 of the container and onto the mounting pins 48. Portions of the lid hinge elements 50 are receive in the slots 34 of the container rim. The rim slots 34 allow the lid to be seated closely on the container rim 26 without the lid hinge elements interfering with the fit of the lid on the container. Each hinge element 50 further includes a stop surface 51, which surface can engage the rear wall 14 of the container to keep the lid in an open, upright position.

The wastebasket of the present invention is further provided with a foot operated pedal mechanism for both opening and closing the lid. This structure is shown generally in FIG. 6 and in greater detail in FIGS. 11–18.

A generally horizontally disposed operating lever 24 is mounted in the lower section 10 of the wastebasket. The operating lever 24 includes an intermediate portion 56, and front and rear portions 58, 60 disposed on opposite sides of the intermediate portion. The operating lever 24 is generally planar in its overall configuration, although the front portion 58 and rear portion 60 are slightly displaced from the intermediate portion 56 at higher and lower levels, respectively.

The operating lever 24 is pivotally mounted on the container. For this purpose, a pair of mounting pins 62 are provided on the lever at its intermediate portion 56, and extend outwardly from opposite lateral sides of the lever. The mounting pins 62 are received in corresponding apertures 64 formed through the thickness of opposite walls 20 of the lower section 10. In this way, the operating lever is held in place at the bottom of the container.

The front portion 58 of the operating lever includes a foot bar or pedal 22. The foot pedal 22 is formed as a flat elongated member which is joined to the intermediate portion 56 through a slot 68 formed on a front wall of the lower section 10. As mentioned previously, the foot pedal 22 is disposed on the front wall 12 of the container and resides in the recess 38 defined by the sloping lower wall 36.

The foot pedal 22 has a width which allows it to extend substantially across the entire width of the front wall 12, as opposed to many conventional, pedal operated trash receptacles that have foot sized pedals. The wide foot pedal or foot bar 22 of the present invention makes it more convenient for the user to open and close the wastebasket lid, as he doesn't have to stretch or take particular aim to actuate the foot pedal 22 as he would with the conventional wastebaskets described above.

The rear portion 60 of the operating lever includes a free end formed with an upturned flange 70. An aperture 72 is formed through the thickness of the flange 70 and, as will be seen, is provided for receiving one end of a linkage interconnecting the operating lever 24 with the lid 6.

The operating lever 24 pivots in a seesaw-type fashion, with the mounting pins 62 at the intermediate portion acting as a fulcrum, whenever pressure is exerted on the foot pedal 22 or released from the pedal. One of the advantages of the present invention is that pressure may be exerted at any point on the foot pedal 22 to actuate the mechanism which opens and closes the lid. Thus, the foot pedal and operating lever must be substantially rigid, and not flex under the pressure of one's foot or the opposing weight of the lid pivoting mechanism, and yet their design must meet desired design criteria of making a substantial portion of the wastebasket from plastic materials and by molding techniques.

To meet these criteria, the underside of the foot pedal 22 and front portion 58 of the operating lever is formed with a plurality of criss-crossed, diagonal stiffening ribs 74 joined to and extending perpendicularly downwardly from a top wall 76 of each, and the rear portion 60 of the operating lever is formed with parallel rows and columns of stiffening ribs 78 also depending perpendicularly from the top wall 76 of the operating lever. The stiffening ribs 74, 78 provide the foot pedal and operating lever with strength and rigidity so that pressure exerted just about anywhere on the foot pedal will open or close the lid.

A linkage is provided between the operating lever 24 and the lid 6 to transmit the pivotal movement of the lever to the lid. Preferably, the linkage is an elongated metal rod 80 having opposite hooked ends. One end of the rod 80 is received in the flange aperture 72 of the operating lever, and the other end is joined to the lid, as will be described.

The rod 80 is mostly housed in the channel 32 formed in the rear wall of the container, which channel extends vertically between the rim 26 and the lower section 10. As seen in FIG. 6, the rod 80 does not protrude from the general periphery of the wastebasket. This not only provides the wastebasket with a more aesthetically pleasing appearance than the Brownell pedal operated wastebasket, but also protects the rod linkage from damage and allows the wastebasket to be used in a confined space and closer to a wall without interfering with the lid opening and closing mechanism.

As shown in FIGS. 6 and 9, the lid 6 is formed with a plate-like flange 82 depending from the top wall 40 and rim 42 of the lid and situated generally at the lid's pivot axis. The flange 82 is also disposed vertically in alignment with the channel 32 of the container so that it is in proper position for connection with the rod linkage 80.

The flange 82 defines an elongated slot 84 which is formed through its thickness. The slot 84 is sloped to the vertical in one direction when the lid is closed (see FIG. 18*a*), and is sloped to the vertical in an opposite direction when the lid is open (FIG. 18*c*).

Figure 18A:
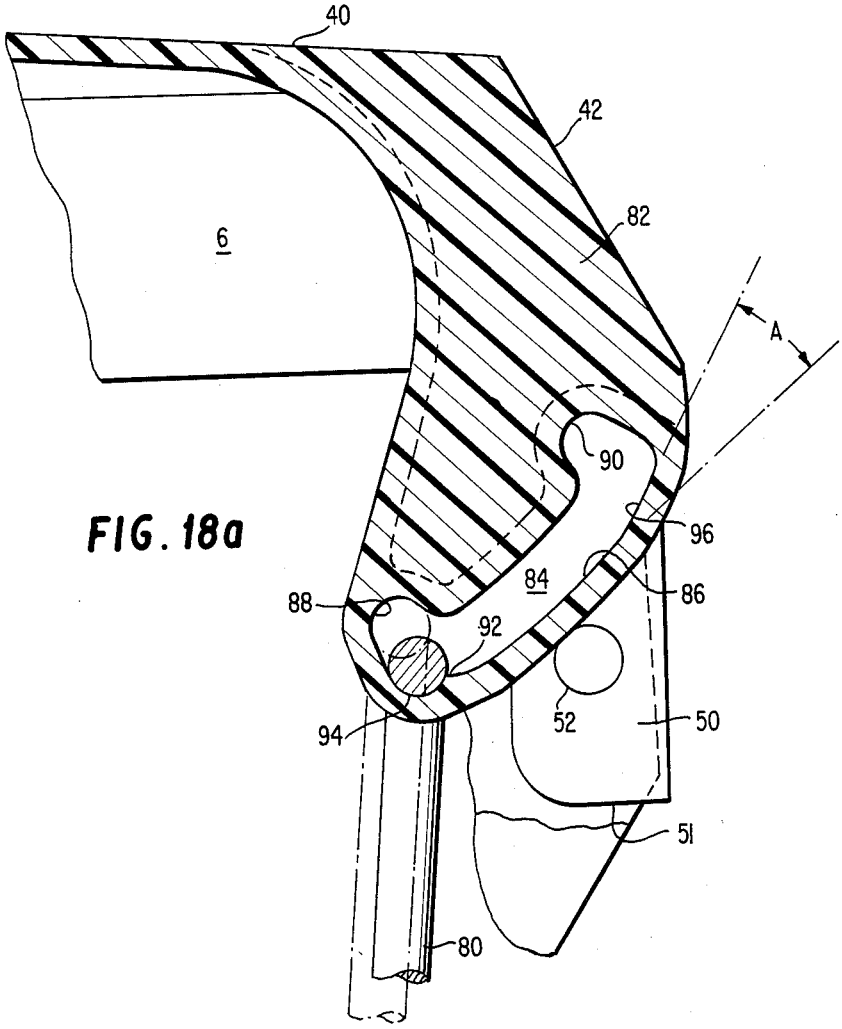
FIGS. 18*a* through *d* are sectional views of the lid movement actuation flange of the wastebasket, illustrating in sequence its operation in opening and closing the lid.

As more specifically shown in FIG. 18*a*, the slot 84 is formed with a central channel 86 and two enlargements 88, 90 disposed at opposite ends of the channel. The enlargements 88, 90 extend upwardly in the lid flange beyond the transverse width of the channel 86, providing the slot with a slight concave or U-shaped configuration. One enlargement 88 is situated more inwardly toward the container's rear wall and on the inner side of the lid pivot axis when the lid is in the closed position. The other enlargement 90 is situated more outwardly of the rear wall and on the outer side of the pivot axis when the lid is in the open position.

The lid flange slot 84 receives the upper hooked end of the rod linkage 80. The slot 84 is dimensioned so that that upper end of the rod fits into either enlargement 88, 90 and may freely slide through the channel 86 of the slot between the enlargements.

The combined weight of the rod linkage 80 and rear portion 60 of the operating lever (i.e., rearward of the lever mounting pins 62) is chosen to be greater than the weight of the foot pedal 22 and forward portion 58 of the operating lever (i.e., forward of the mounting pins). In this way, the foot pedal 22 will rise freely when pressure on the pedal is released, and the upper end of the rod linkage 80 will slide freely by gravity from whichever enlargement is higher, through the channel 86 and into the lower enlargement.

The operation of the lid opening and closing mechanism described above can be explained in the sequence illustrated by FIGS. 18*a* through d. FIG. 18*a* shows the lid 6 in a closed position covering the container opening. When the lid is in this position, the slot 84 is sloped inwardly, with the inner enlargement 88 being lower than the outer enlargement 90. The rod 80 rests in the inner enlargement 88, and the foot pedal 22 is in a raised condition on the front wall of the container.

Figure 18B:
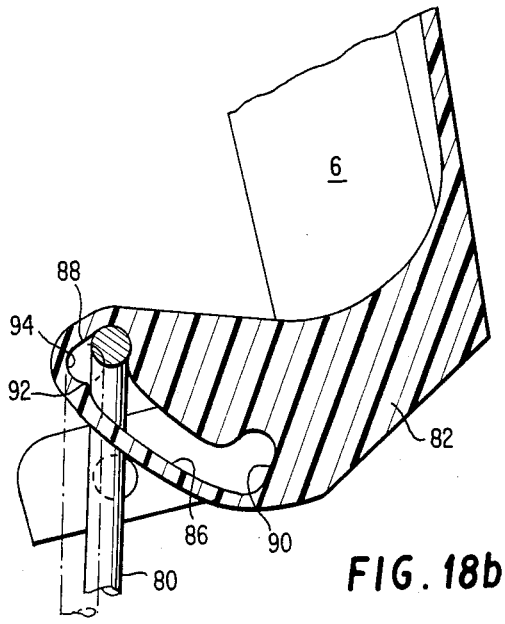
Figure 18C:
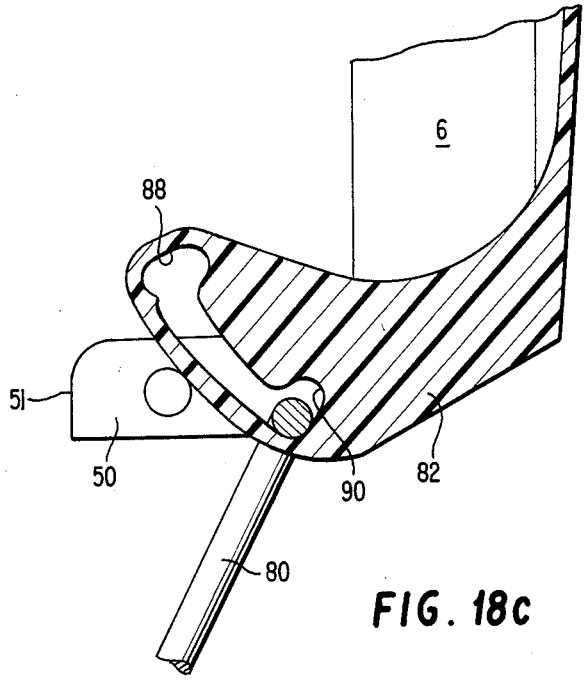

When the foot pedal 22 is stepped on, the operating lever 24 pivots to raise the rod 80 into the top of the inner enlargement 88. The rod exerts a force on the lid flange 82 sufficient to raise the lid from the container and pivot it about the lid mounting pins 48 to a substantially vertical, upright position uncovering the container opening, as shown in FIG. 18*b*. In this position, the inner enlargement 88 is now higher than the outer enlargement 90.

When pressure on the foot pedal 22 is released, the rod 80 slides from the now higher, inner enlargement 88, through the channel 86 and into the lower outer enlargement 90, as shown in FIG. 18*c*, and the foot pedal 22 returns to its raised state due to the greater weight of the rear portion 60 of the operating lever and the rod 80.

Figure 18D:
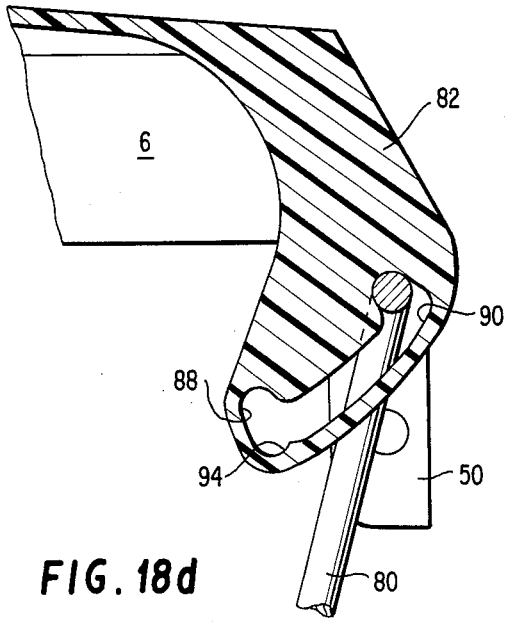

If the foot pedal 22 is stepped on again, the upper end of the rod linkage 80 will be raised by the operating lever into engagement with the lid flange 82 at the top of the outer enlargement 90. The rod 80 exerts a force on the lid flange 82 causing the lid to swing about the pivot axis in the opposite direction to a closed position covering the container, as shown in FIG. 18*d*. The slope of the flange slot 84 has now reversed and the outer enlargement 90 is higher. Releasing the foot pedal 22 will allow it to rise and will let the rod 80 slide from the higher outer enlargement 90 through the channel 86 to the lower inner enlargement 88.

As mentioned previously, one of the objectives of the invention is to provide a wastebasket whose lid pivoting mechanism does not protrude from the general periphery of the wastebasket to any great degree. To meet this objective, substantially the entire operating lever, including its flange 70 to which the rod linkage 80 is pivotally connected, is housed within the lower section 10 of the container, and the rod linkage 80 resides almost entirely within the channel 32. Thus, unlike the linkage of the receptacle disclosed in the Brownell patent, the flange 70 is not positioned below the lid pivot axis, but rather is situated more inwardly of the container. Also, rod 80 does not alternately tilt to opposite sides of the vertical, but rather is always tilted away from the container.

To ensure that the rod linkage moves in the desired direction during the lid opening and closing operation, the lid flange 82 is particularly shaped to help guide the rod 80. More specifically, the lid flange includes a ridge 92 which protrudes into the slot 84 at its lower side between the inner enlargement 88 and the channel 86. The ridge 92 defines a slight constriction in the channel.

Without such a ridge 92 for guiding the rod, when pressure is gradually exerted on the foot pedal 22 to open the lid so that the rod 80 rises rather slowly, it is possible for the rod to slip out of the inner enlargement 88 and into the channel 86 rather than properly engage the lid flange at the top of the inner enlargement. The ridge 92, on the other hand, helps direct the rod 80 towards the top of the inner enlargement 88, and the constriction it presents between the enlargement 88 and channel 86 helps prevent the rod from slipping into the channel under the conditions described above. The ridge 92 also provides a well defined, curved seat surface 94 at the bottom of the inner enlargement 88 into which the rod 80 will come to rest when the lid is in the closed position so that the rod is properly seated in the enlargement 88 below that portion of the lid flange it is to engage when the foot pedal is actuated.

It has also been found that the rod 80 will correctly slide into place within the outer enlargement 90 and will be properly directed towards the top of the enlargement when the foot pedal is stepped on if a portion 96 of the channel at the entrance to the enlargement 90 is turned upwardly at an angle A from the rest of the channel 86. The preferred angle A of slope at channel portion 96 is about 15° to 20° and is optimally set at 18°. With such an upturned channel portion 96, the rod 80 will be properly guided as it slides between the channel and the outer enlargement 90, and will be directed to engage the lid flange at the top of enlargement 90.

The present invention provides a wastebasket which takes up little space, making it quite adaptable for use in confined areas. The foot pedal and pedal linkage are confined within the overall periphery of the wastebasket and do not protrude from the wastebasket. The pedal is reinforced so that if stepped on at substantially any point, it will cause the lid to pivot on the container.

The foot pedal is also wide, extending across the entire front of the container. This makes it easier for the user to reach with his foot and step on to pivot the lid.

Actuation of the foot pedal will both open and close the lid. The particular shape of the slot formed in the lid flange ensures that the rod linkage will properly engage the lid flange at the enlargements.

The wastebasket of the present invention is perfectly adaptable for household use. It is lightweight in construction, and is formed substantially from plastic materials and by conventional molding techniques.

lid's top wall 40, as shown in FIGS. 8 and 9. The support members 44 engage the horizontal portion 28 of the container rim at the two front corners of the container, and function to support the lid on the rim 26 of the container.

As mentioned earlier, the lid 6 is mounted on the container 2 and is pivotable between a closed position, covering the container's open end 4, and an open position, where it is in a substantially upright, vertical disposition uncovering the open end. The structure for mounting the lid on the container is shown in FIGS. 3–5, 7, 9 and 10 and will now be described.

Two pairs of parallel, spaced apart ribs 46 are provided on the container. The ribs 46 of each pair straddle a corresponding slot 34 formed in the container rim and extend outwardly from the rear wall 14 of the container and downwardly from the container rim 26. A pin 48 extends from one rib 46 of each pair partially across the gap between the ribs, providing enough space between the free end of the pin 48 and the adjacent rib to allow a hinge element of the lid to be inserted between them.

The lid includes a pair of spaced apart hinge elements 50 formed as planar, depending members joined to the top wall 40 and rim 42 of the lid. Each hinge element 50 is formed with an aperture 52 through its thickness, which aperture receives a corresponding mounting pin 48. The lid is mounted on the container by force-fitting the hinge elements 50 between the ribs 46 of the container and onto the mounting pins 48. Portions of the lid hinge elements 50 are receive in the slots 34 of the container rim. The rim slots 34 allow the lid to be seated closely on the container rim 26 without the lid hinge elements interfering with the fit of the lid on the container. Each hinge element 50 further includes a stop surface 51, which surface can engage the rear wall 14 of the container to keep the lid in an open, upright position.

The wastebasket of the present invention is further provided with a foot operated pedal mechanism for both opening and closing the lid. This structure is shown generally in FIG. 6 and in greater detail in FIGS. 11–18.

A generally horizontally disposed operating lever 24 is mounted in the lower section 10 of the wastebasket. The operating lever 24 includes an intermediate portion 56, and front and rear portions 58, 60 disposed on opposite sides of the intermediate portion. The operating lever 24 is generally planar in its overall configuration, although the front portion 58 and rear portion 60 are slightly displaced from the intermediate portion 56 at higher and lower levels, respectively.

The operating lever 24 is pivotally mounted on the container. For this purpose, a pair of mounting pins 62 are provided on the lever at its intermediate portion 56, and extend outwardly from opposite lateral sides of the lever. The mounting pins 62 are received in corresponding apertures 64 formed through the thickness of opposite walls 20 of the lower section 10. In this way, the operating lever is held in place at the bottom of the container.

The front portion 58 of the operating lever includes a foot bar or pedal 22. The foot pedal 22 is formed as a flat elongated member which is joined to the intermediate portion 56 through a slot 68 formed on a front wall of the lower section 10. As mentioned previously, the foot pedal 22 is disposed on the front wall 12 of the container and resides in the recess 38 defined by the sloping lower wall 36.

The foot pedal 22 has a width which allows it to extend substantially across the entire width of the front wall 12, as opposed to many conventional, pedal operated trash receptacles that have foot sized pedals. The wide foot pedal or foot bar 22 of the present invention makes it more convenient for the user to open and close the wastebasket lid, as he doesn't have to stretch or take particular aim to actuate the foot pedal 22 as he would with the conventional wastebaskets described above.

The rear portion 60 of the operating lever includes a free end formed with an upturned flange 70. An aperture 72 is formed through the thickness of the flange 70 and, as will be seen, is provided for receiving one end of a linkage interconnecting the operating lever 24 with the lid 6.

The operating lever 24 pivots in a seesaw-type fashion, with the mounting pins 62 at the intermediate portion acting as a fulcrum, whenever pressure is exerted on the foot pedal 22 or released from the pedal. One of the advantages of the present invention is that pressure may be exerted at any point on the foot pedal 22 to actuate the mechanism which opens and closes the lid. Thus, the foot pedal and operating lever must be substantially rigid, and not flex under the pressure of one's foot or the opposing weight of the lid pivoting mechanism, and yet their design must meet desired design criteria of making a substantial portion of the wastebasket from plastic materials and by molding techniques.

To meet these criteria, the underside of the foot pedal 22 and front portion 58 of the operating lever is formed with a plurality of criss-crossed, diagonal stiffening ribs 74 joined to and extending perpendicularly downwardly from a top wall 76 of each, and the rear portion 60 of the operating lever is formed with parallel rows and columns of stiffening ribs 78 also depending perpendicularly from the top wall 76 of the operating lever. The stiffening ribs 74, 78 provide the foot pedal and operating lever with strength and rigidity so that pressure exerted just about anywhere on the foot pedal will open or close the lid.

A linkage is provided between the operating lever 24 and the lid 6 to transmit the pivotal movement of the lever to the lid. Preferably, the linkage is an elongated metal rod 80 having opposite hooked ends. One end of the rod 80 is received in the flange aperture 72 of the operating lever, and the other end is joined to the lid, as will be described.

The rod 80 is mostly housed in the channel 32 formed in the rear wall of the container, which channel extends vertically between the rim 26 and the lower section 10. As seen in FIG. 6, the rod 80 does not protrude from the general periphery of the wastebasket. This not only provides the wastebasket with a more aesthetically pleasing appearance than the Brownell pedal operated wastebasket, but also protects the rod linkage from damage and allows the wastebasket to be used in a confined space and closer to a wall without interfering with the lid opening and closing mechanism.

As shown in FIGS. 6 and 9, the lid 6 is formed with a plate-like flange 82 depending from the top wall 40 and rim 42 of the lid and situated generally at the lid's pivot axis. The flange 82 is also disposed vertically in alignment with the channel 32 of the container so that it is in proper position for connection with the rod linkage 80.

The flange 82 defines an elongated slot 84 which is formed through its thickness. The slot 84 is sloped to the vertical in one direction when the lid is closed (see FIG. 18*a*), and is sloped to the vertical in an opposite direction when the lid is open (FIG. 18*c*).

As more specifically shown in FIG. 18*a*, the slot 84 is formed with a central channel 86 and two enlargements 88, 90 disposed at opposite ends of the channel. The enlargements 88, 90 extend upwardly in the lid flange beyond the transverse width of the channel 86, providing the slot with a slight concave or U-shaped configuration. One enlargement 88 is situated more inwardly toward the container's rear wall and on the inner side of the lid pivot axis when the lid is in the closed position. The other enlargement 90 is situated more outwardly of the rear wall and on the outer side of the pivot axis when the lid is in the open position.

The lid flange slot 84 receives the upper hooked end of the rod linkage 80. The slot 84 is dimensioned so that that upper end of the rod fits into either enlargement 88, 90 and may freely slide through the channel 86 of the slot between the enlargements.

The combined weight of the rod linkage 80 and rear portion 60 of the operating lever (i.e., rearward of the lever mounting pins 62) is chosen to be greater than the weight of the foot pedal 22 and forward portion 58 of the operating lever (i.e., forward of the mounting pins). In this way, the foot pedal 22 will rise freely when pressure on the pedal is released, and the upper end of the rod linkage 80 will slide freely by gravity from whichever enlargement is higher, through the channel 86 and into the lower enlargement.

The operation of the lid opening and closing mechanism described above can be explained in the sequence illustrated by FIGS. 18*a* through d. FIG. 18*a* shows the lid 6 in a closed position covering the container opening. When the lid is in this position, the slot 84 is sloped inwardly, with the inner enlargement 88 being lower than the outer enlargement 90. The rod 80 rests in the inner enlargement 88, and the foot pedal 22 is in a raised condition on the front wall of the container.

When the foot pedal 22 is stepped on, the operating lever 24 pivots to raise the rod 80 into the top of the inner enlargement 88. The rod exerts a force on the lid flange 82 sufficient to raise the lid from the container and pivot it about the lid mounting pins 48 to a substantially vertical, upright position uncovering the container opening, as shown in FIG. 18*b*. In this position, the inner enlargement 88 is now higher than the outer enlargement 90.

When pressure on the foot pedal 22 is released, the rod 80 slides from the now higher, inner enlargement 88, through the channel 86 and into the lower outer enlargement 90, as shown in FIG. 18*c*, and the foot pedal 22 returns to its raised state due to the greater weight of the rear portion 60 of the operating lever and the rod 80.

If the foot pedal 22 is stepped on again, the upper end of the rod linkage 80 will be raised by the operating lever into engagement with the lid flange 82 at the top of the outer enlargement 90. The rod 80 exerts a force on the lid flange 82 causing the lid to swing about the pivot axis in the opposite direction to a closed position covering the container, as shown in FIG. 18*d*. The slope of the flange slot 84 has now reversed and the outer enlargement 90 is higher. Releasing the foot pedal 22 will allow it to rise and will let the rod 80 slide from the higher outer enlargement 90 through the channel 86 to the lower inner enlargement 88.

As mentioned previously, one of the objectives of the invention is to provide a wastebasket whose lid pivoting mechanism does not protrude from the general periphery of the wastebasket to any great degree. To meet this objective, substantially the entire operating lever, including its flange 70 to which the rod linkage 80 is pivotally connected, is housed within the lower section 10 of the container, and the rod linkage 80 resides almost entirely within the channel 32. Thus, unlike the linkage of the receptacle disclosed in the Brownell patent, the flange 70 is not positioned below the lid pivot axis, but rather is situated more inwardly of the container. Also, rod 80 does not alternately tilt to opposite sides of the vertical, but rather is always tilted away from the container.

To ensure that the rod linkage moves in the desired direction during the lid opening and closing operation, the lid flange 82 is particularly shaped to help guide the rod 80. More specifically, the lid flange includes a ridge 92 which protrudes into the slot 84 at its lower side between the inner enlargement 88 and the channel 86. The ridge 92 defines a slight constriction in the channel.

Without such a ridge 92 for guiding the rod, when pressure is gradually exerted on the foot pedal 22 to open the lid so that the rod 80 rises rather slowly, it is possible for the rod to slip out of the inner enlargement 88 and into the channel 86 rather than properly engage the lid flange at the top of the inner enlargement. The ridge 92, on the other hand, helps direct the rod 80 towards the top of the inner enlargement 88, and the constriction it presents between the enlargement 88 and channel 86 helps prevent the rod from slipping into the channel under the conditions described above. The ridge 92 also provides a well defined, curved seat surface 94 at the bottom of the inner enlargement 88 into which the rod 80 will come to rest when the lid is in the closed position so that the rod is properly seated in the enlargement 88 below that portion of the lid flange it is to engage when the foot pedal is actuated.

It has also been found that the rod 80 will correctly slide into place within the outer enlargement 90 and will be properly directed towards the top of the enlargement when the foot pedal is stepped on if a portion 96 of the channel at the entrance to the enlargement 90 is turned upwardly at an angle A from the rest of the channel 86. The preferred angle A of slope at channel portion 96 is about 15° to 20° and is optimally set at 18°. With such an upturned channel portion 96, the rod 80 will be properly guided as it slides between the channel and the outer enlargement 90, and will be directed to engage the lid flange at the top of enlargement 90.

The present invention provides a wastebasket which takes up little space, making it quite adaptable for use in confined areas. The foot pedal and pedal linkage are confined within the overall periphery of the wastebasket and do not protrude from the wastebasket. The pedal is reinforced so that if stepped on at substantially any point, it will cause the lid to pivot on the container.

The foot pedal is also wide, extending across the entire front of the container. This makes it easier for the user to reach with his foot and step on to pivot the lid.

Actuation of the foot pedal will both open and close the lid. The particular shape of the slot formed in the lid flange ensures that the rod linkage will properly engage the lid flange at the enlargements.

The wastebasket of the present invention is perfectly adaptable for household use. It is lightweight in construction, and is formed substantially from plastic materials and by conventional molding techniques.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A wastebasket, which comprises:

a container having a top opening formed therein;

a lid mounted on the container and adapted to pivot about a pivot axis to cover and uncover the top opening; and means for actuating pivotal movement of the lid with respect to the container between positions covering and uncovering the top opening, the lid movement actuating means including a generally horizontal operating lever pivotally mounted on the container at a lower portion thereof, means defining a slot mounted on the lid and situated thereon generally at the lid pivot axis, and link means interconnecting the operating lever and slot defining means;

the operating lever having an intermediate portion pivotally mounted on the container, and front and rear portions disposed on opposite sides of the intermediate portion, the front portion including an operating pedal;

the link means being joined to the operating lever at the rear portion thereof and extending upwardly therefrom to the slot defining means, the link means including an upper end portion slidably engageable in the slot, the link means being adapted to be raised and lowered by pivotal movement of the operating lever;

the slot being defined with an elongated channel, and with first and second enlargements situated at opposite ends of the elongated channel and disposed on opposite sides of the pivot axis;

the slot defining means including a ridge protruding inwardly of the slot and situated at the end of the channel near the first enlargement, and defining the channel with a portion which is upwardly turned at an angle toward the second enlargement;

wherein the upper end portion of the link means is received by the first enlarged and guided by the ridge into engagement with the lid flange at the top of the first enlargement when the link means is raised by the operating lever to pivot the lid to the open position, the upper end portion sliding through the channel from the first enlargement to the second enlargement when the lid is in the open position and pressure on the operating pedal is released, and wherein the upper end portion engages the slot defining means at the top of the second enlargement when the link means is raised by the operating lever to pivot the lid to the closed position, the upper end portion sliding through the channel from the second enlargement to the first enlargement when the lid is in the closed position and pressure on the operating pedal is released.

2. A wastebasket, which comprises:

a container having a top opening formed therein;

a lid pivotally mounted on the container and adapted to pivot about a pivot axis to cover and uncover the top opening;

means for pivotally mounting the lid to the container; and means for actuating pivotal movement of the lid with respect to the container between positions covering and uncovering the top opening, the lid movement actuating means including a generally horizontal operating lever mounted on the container at the lower portion thereof, means defining a slot mounted on the lid and situated thereon generally at the pivot axis, and link means operatively interconnecting the operating lever and slot defining means and having an upper end portion;

the slot being defined with an elongated channel, and with first and second enlargements situated at opposite ends of the elongated channel and disposed on opposite sides of the pivot axis, the first enlargement being disposed at a lower level than the second enlargement when the lid is in a closed position covering the top opening, and the second enlargement being disposed at a lower level than the first enlargement when the lid is in an open position uncovering the top opening, the upper end portion of the link means being adapted to slide in the slot between the first and second enlargements;

the slot defining means further including guide means for guiding the upper end portion of the link means in its movement in the slot, whereby actuation of the operating lever when the lid is in the closed position causes the upper end of the link means to engage the slot defining means at the first enlargement and exert a force thereon to pivot the lid to the open position, and whereby actuation of the operating lever when the lid is in the open position causes the upper end of the link means to engage the slot defining means at the second enlargement and exert a force thereon to pivot the lid to the closed position, wherein the guide means includes a ridge protruding inwardly of the slot and situated at the end of the channel near the first enlargement, the ridge defining a construction in the channel and being adapted to direct the upper end portion of the link means towards the top of the first enlargement upon actuation of the operating lever when the lid is in the closed position.

3. A wastebasket as defined by claim 1, wherein the slot defining means further defines the slot with a seat surface situated at the bottom of the first enlargement for receiving the upper end of the link means when the lid is in the closed position and the operating lever is not actuated.

4. A wastebasket as defined by claim 1, wherein the guide means includes a portion of the channel turned upwardly at an angle toward the second enlargement, the channel portion being adapted to direct the upper end portion of the link means towards the top of the second enlargement upon actuation of the operating lever when the lid is in the open position.

5. A wastebasket as defined by claim 1, wherein the lid mounting means includes at least one lid hinge element formed as a depending member joined to the lid, and at least one pair of parallel, spaced apart ribs mounted on the container and defining a space therebetween, one of the ribs including a mounting pin protruding therefrom and extending partially between the ribs in the space defined therebetween, the lid hinge element including an aperture, which aperture is adapted to receive the mounting pin to mount the lid on the container.

6. A wastebasket as defined by claim 1, wherein the container further includes an upper rim surrounding the top opening; and wherein the lid includes support members joined to the lid and extending downwardly therefrom, the support members being adapted to engage the rim of the container and support the lid on the container when the lid is in the closed position.

7. A wastebasket as defined by claim 1, wherein the link means is an elongated rod.

8. A wastebasket as defined by claim 1, wherein the slot defining means is a plate-like flange depending from the lid, the slot being formed through the thickness of the flange.

9. A wastebasket as defined by claim 1, wherein the container has an overall rectangular shape and includes front and rear walls; and wherein the operating lever includes a plate-like operating pedal disposed on the front wall of the container, the operating pedal extending substantially across the entire width of the front wall and being operable to effect pivotal movement of the lid when pressure is exerted at substantially any point thereon.

10. A wastebasket as defined by claim 9, wherein the front wall of the container includes a bottom portion sloping downwardly and inwardly of the container and defining a recess, the operating pedal being disposed in the recess so as not to protrude substantially beyond the overall periphery of the container.

11. A wastebasket as defined by claim 9, wherein the operating lever includes reinforcing means for strengthening the operating lever.

12. A wastebasket as defined by claim 11, wherein the reinforcing means includes a plurality of ribs disposed perpendicularly to a surface of the operating lever.

13. A wastebasket as defined by claim 1, wherein the container includes a rear wall, the lid being pivotally mounted on the container generally at the rear wall thereof; and wherein a channel is formed in the surface of the rear wall and extends upwardly thereon, the channel being adapted to at least partially receive the link means.

* * * * *